US008777880B2

(12) United States Patent
Davis et al.

(10) Patent No.: US 8,777,880 B2
(45) **Date of Patent: *Jul. 15, 2014**

(54) FORCE-MULTIPLYING PERCUSSOR AND SELF-APPLICATOR SYSTEM FOR AIRWAY CLEARANCE

(71) Applicant: Susan B. Davis, San Diego, CA (US)

(72) Inventors: Susan B. Davis, San Diego, CA (US); James E. Davis, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/657,548

(22) Filed: Oct. 22, 2012

(65) Prior Publication Data

US 2013/0046215 A1 Feb. 21, 2013

Related U.S. Application Data

(63) Continuation-in-part of application No. 13/422,402, filed on Mar. 16, 2012, and a continuation-in-part of application No. 12/596,511, filed on Oct. 19, 2009, now abandoned.

(51) Int. Cl.

| | |
|---|---|
| ***A61H 1/00*** | (2006.01) |
| ***A61H 23/02*** | (2006.01) |
| ***A61H 11/00*** | (2006.01) |

(52) U.S. Cl.

CPC ..... *A61H 1/008* (2013.01); *A61H 2201/0153* (2013.01); *A61H 2201/0157* (2013.01); *A61H 23/0218* (2013.01); *A61H 2201/0214* (2013.01); *A61H 2201/1623* (2013.01); *A61H 11/00* (2013.01); *A61H 2201/50* (2013.01); *A61H 2201/0242* (2013.01); *A61H 2205/084* (2013.01); *A61H 2205/081* (2013.01)

USPC ..... 601/48; 601/46; 601/107; 601/108

(58) Field of Classification Search

USPC ..... 601/46, 48, 51, 54, 56–60, 66–74, 601/78–81, 84, 87, 89, 90, 93, 97, 98, 101, 601/107, 108, 134, 135

See application file for complete search history.

(56) References Cited

U.S. PATENT DOCUMENTS

| | | | | |
|---|---|---|---|---|
| 1,634,373 | A | | 7/1927 | Mann |
| 1,837,197 | A | * | 12/1931 | Berman ..... 310/30 |
| 2,021,968 | A | | 11/1935 | Scheidegger |
| 2,985,166 | A | | 5/1961 | Burkardt |
| 3,308,892 | A | | 3/1967 | Palmer |
| 4,069,816 | A | | 1/1978 | Yamamura et al. |

(Continued)

FOREIGN PATENT DOCUMENTS

| | | | |
|---|---|---|---|
| JP | 06120866 | A | 4/1994 |
| WO | 2006-001656 | A1 | 1/2006 |

*Primary Examiner* — Justine Yu
*Assistant Examiner* — LaToya M Louis
(74) *Attorney, Agent, or Firm* — Kelly & Kelley, LLP

(57) ABSTRACT

An airway clearance combines a force multiplying percussor and a self-applicator assembly. The percussor has an anvil, a hammer, a coil, and a pulse generator. The anvil has a force receiving surface and a force delivering surface. The hammer also has a force-receiving surface and a force-delivering surface, and is attached to the anvil such that the hammer's force delivering surface and the anvil's force receiving surface are mechanically free to come together or move apart. When energized with an electrical current, the coil forces the hammer's force delivering surface and the anvil's force receiving surface to separate. The pulse generator supplies pulses of electrical current to the coil.

28 Claims, 9 Drawing Sheets

(56) References Cited

U.S. PATENT DOCUMENTS

| | | | | | |
|---|---|---|---|---|---|
| 4,237,987 | A | | 12/1980 | Sherman | |
| 4,433,803 | A | * | 2/1984 | Liberboim | 224/251 |
| 4,512,339 | A | | 4/1985 | McShirley | |
| 4,549,535 | A | | 10/1985 | Wing | |
| 4,788,968 | A | | 12/1988 | Rudashevsky et al. | |
| 4,841,955 | A | | 6/1989 | Evans et al. | |
| 5,361,437 | A | | 11/1994 | Zhu et al. | |
| 5,397,040 | A | * | 3/1995 | Lee | 224/679 |
| 5,545,456 | A | * | 8/1996 | Suida | 15/222 |
| 5,716,388 | A | * | 2/1998 | Petelle | 607/108 |
| 5,979,006 | A | * | 11/1999 | Stokes et al. | 15/222 |
| 6,537,235 | B1 | * | 3/2003 | Connor et al. | 601/70 |
| 6,554,787 | B1 | * | 4/2003 | Griffin et al. | 607/109 |
| 6,585,673 | B1 | * | 7/2003 | Bass | 602/60 |
| 2004/0260212 | A1 | | 12/2004 | Cho | |
| 2005/0090863 | A1 | * | 4/2005 | Miller | 606/239 |
| 2005/0222654 | A1 | * | 10/2005 | Brown | 607/109 |
| 2005/0234373 | A1 | * | 10/2005 | Khalaf | 601/71 |
| 2007/0167885 | A1 | * | 7/2007 | Moon | 601/71 |
| 2008/0294077 | A1 | * | 11/2008 | Walker | 601/135 |
| 2009/0192423 | A1 | * | 7/2009 | Halmos | 601/134 |
| 2010/0113993 | A1 | | 5/2010 | Davis et al. | |

* cited by examiner

FORCE-MULTIPLYING PERCUSSOR AND SELF-APPLICATOR SYSTEM FOR AIRWAY CLEARANCE

FIELD OF THE INVENTION

The invention relates to airway clearance treatments. Specifically, the present invention is directed to a force-multiplying percussor and self-applicator system for airway clearance. A percussor is a medical device for supplying impulse forces to a patient's back or chest for the purpose of loosening and dislodging bronchial secretions in the lungs. A self-applicator is a strap that holds a percussor in a secure manner such that an individual can apply the percussor to their back without assistance from another person.

BACKGROUND OF THE INVENTION

A percussor is a medical device for supplying impulse forces to a patient's back or chest for the purpose of loosening and dislodging bronchial secretions in the lungs. The present invention is of a system of straps to allow a person to properly apply a percussor against his or her own back.

The type of percussor is based on the use of a solenoid in developing impulse forces for application to a patient's back or chest, A "solenoid", as defined in the McGRAW-HILL, DICTIONARY OF SCIENTIFIC AND TECHNICAL TERMS, Fourth Edition, Sybil P. Parker, Editor in Chief, McGraw-Hill Book Company, New York, N.Y., 1989, is "a coil that surrounds a movable iron core which is pulled to a central position with respect to the coil when the coil is energized by sending current through it."

An example of this type of percussor is described in U.S. Pat. No. 4,512,339 as a device which energizes a coil to develop an impulse force for application to a patient and utilizes a compressed spring to return the movable iron core to its rest position. The designs of percussors of this type are unnecessarily complicated and inflexible with respect to theft use in treating patients and the adjustment of the operating parameters of the devices.

The present invention avoids the complexities and inflexibilities of the prior art by utilizing a solenoid in a new and different way in generating impulse forces. The present invention utilizes the solenoid only for returning the movable iron core to its rest position. The patient-experienced impulse forces that result from the present invention are multiplied versions of the continuing force applied by a technician in using the invention.

By the nature of such a percussor and human physiology, it is extremely difficult for individual to self-apply a percussor to their own back. The present invention makes it possible for an individual to hold a percussor against his or her own back so as to properly apply the impacting force for the purpose of loosening and dislodging bronchial secretions in the lungs. The person can self-apply the percussor so as to not require the services of a technician in using the percussor.

Accordingly, there is a need for a self-applicator for an airway clearance device that addresses these needs. The present invention fulfills these needs and provides other related advantages.

SUMMARY OF THE INVENTION

The present invention is directed broadly to a medical device for supplying impulse forces to a patient's back or chest for the purpose of loosening and dislodging bronchial secretions in the lungs. More particularly, the invention is a force-multiplying percussor and self-applicator system for airway clearance. The force-multiplying percussor comprises an anvil, a hammer, a con, and a pulse generator. The self-applicator comprises first and second straps joined at their respective ends. The first strap overlays and is substantially co-extensive with the second strap. A pouch for holding the percussor is disposed between the first and second straps. The self-applicator also comprises a pair of handles with one each attached to one of the respective ends of the first and second straps.

In the percussor, the anvil is equipped with a force-receiving surface and a force-delivering surface which are rigidly connected together, the force-delivering surface being intended for contact with a patient's body. The hammer is also equipped with a force-receiving surface and a force-delivering surface, the hammer being oriented with respect to the anvil in such a way that the force-delivering surface of the hammer and the force receiving surface of the anvil are mechanically free to come together or move apart.

The coil forces the force-delivering surface of the hammer and the force-receiving surface of the anvil to separate when the solenoid is energized with an electrical current. The puke generator supplies repeated electrical current pukes to the coil which causes repeated force-multiplied impulse forces to be applied to a patient's body via the force-delivering surface of the anvil whenever the technician applies a continuing force to the force-receiving surface of the hammer.

In the self-applicator, the first strap is preferably longer than the second strap so as to define an open region between the two straps. The second strap has an application surface on one side. The application surface comprises a padded material and is configured so as to make physical contact with a user's back. The pouch is disposed in the open region. The pouch is attached to at least one and preferably both of the straps.

The pouch comprises a closure mechanism. The closure mechanism is configured so as to securely hold the percussor. The closure mechanism comprises adjustable hook and loop straps configured so as to accommodate percussors of varying sizes.

At least one of the pair of handles is attached to one of the ends of the first and second straps by an adjustable length harness. The other of the pair of handles is attached to the other of the ends of the first and second straps by a fixed length harness.

A method for using the force-multiplying percussor and self-applicator system begins with the step of inserting the percussor into the pouch. The percussor is positioned in the pouch such that an anvil is oriented toward the second strap. A user then grasps each of the pair of handles in his/her hands. The user then self-applies the application surface of the second strap to his/her back. The percussor is turned on such that a force delivering surface of the anvil contacts the user's back through the application surface.

The method further comprises the step of closing the closure mechanism on the pouch so as to securely hold the percussor in the pouch. The method also comprises the step of adjusting the length of the adjustable length harness on one of the pair of handles so that the user can comfortably perform the self-applying step.

Other features and advantages of the present invention will become apparent from the following more detailed description, taken in conjunction with the accompanying drawings, which illustrate, by way of example, the principles of the invention.

BRIEF DESCRIPTION OF DRAWINGS

The accompanying drawings illustrate the invention. In such drawings.

DETAILED DESCRIPTION OF THE PREFERRED EMBODIMENTS

Figure 1:
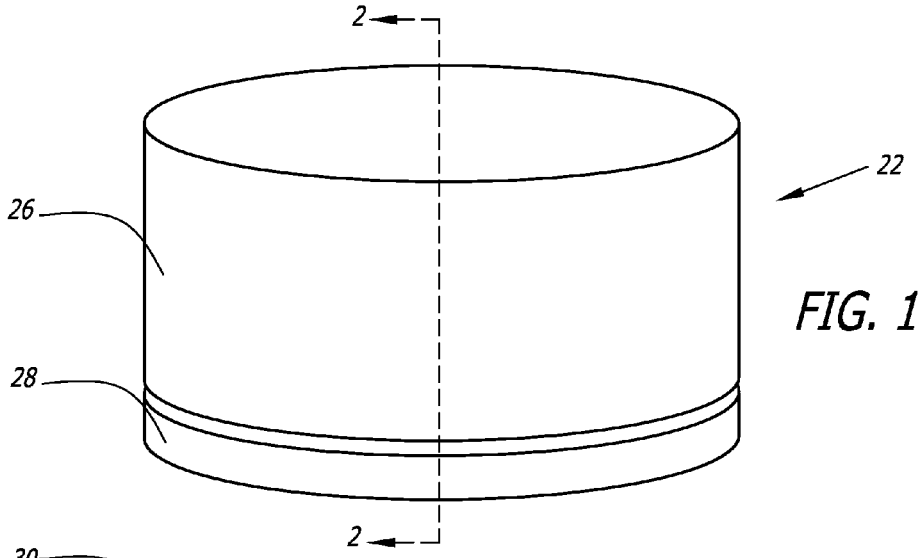
FIG. 1 is a perspective view of a first embodiment of the percussor of the present invention.

The present invention is directed to a force-multiplying percussor and self-applicator system for airway clearance, the system being referred to generally by reference numeral 20. The system 20 comprises a percussor 22 and a self-applicator 24, all of which are illustrated in FIGS. 1-12.

Figure 2:
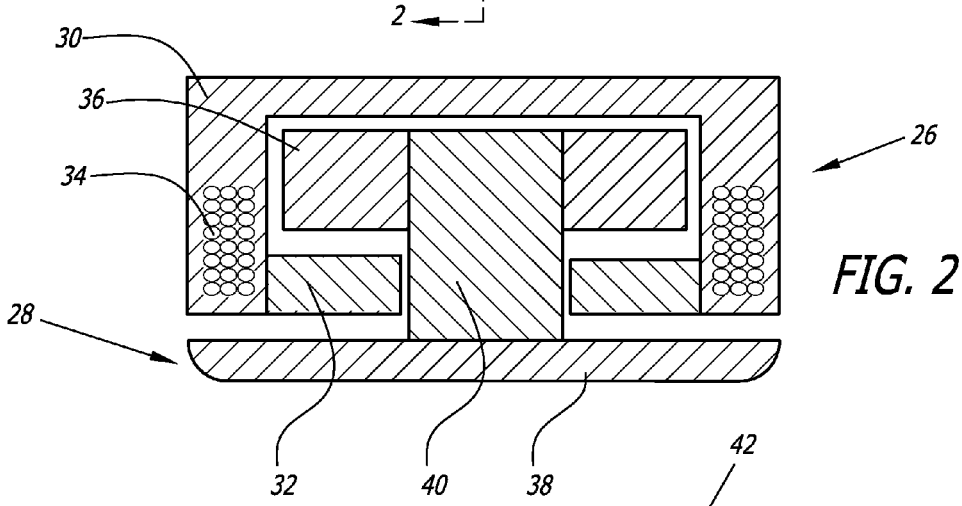
FIG. 2 is a sectional view taken along line 2-2 of FIG. 1 with the hammer shown in a neutral position relative to the anvil.
Figure 3:
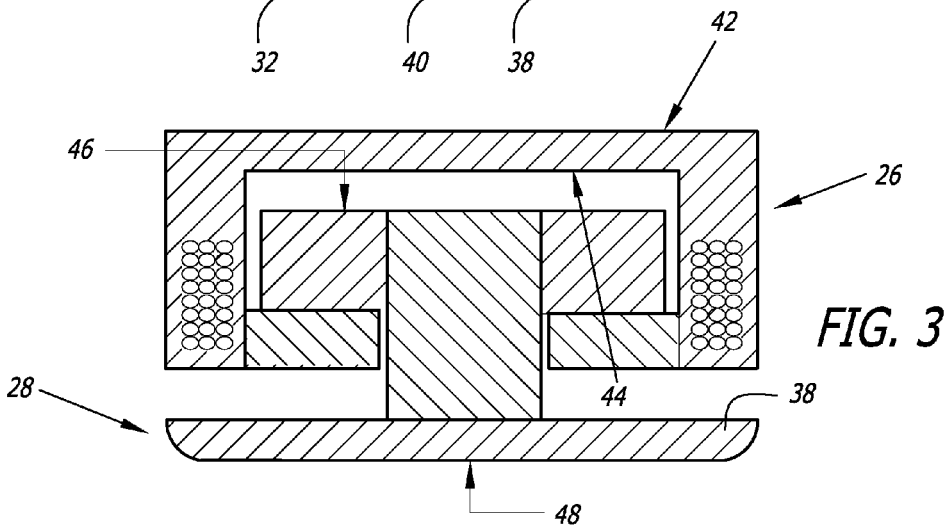
FIG. 3 is a sectional view taken along line 2-2 of FIG. 1 with the hammer shown fully-withdrawn from contact with the anvil.

A first embodiment of the percussor 22 is shown in FIGS. 1-3. The percussor 22 of the present invention consists of a hammer 26 and an anvil 28 oriented with respect to one another such that the hammer 28 may impact the anvil 28. The percussor 22 is configured to be placed on the back or chest of a patient with the anvil 28 in contact with the patient's body. Typically, a user holds the percussor 22 in place by gripping the hammer 26 with one hand, palm on top, and then turns on the power. The force continually applied by the user to the hammer 26 is converted by the percussor 22 into repeated force-multiplied impulses in which the force associated with each impulse is significantly greater than the force being applied by the user on a continuing basis.

The details of the percussor 22 design are shown in the sectional views of FIGS. 2 and 3. The hammer 26 consists of a plastic structural member 30 attached to guiding member 32. Guiding member 32 may be either metal or plastic and attaches to structural member 30 utilizing mating threaded regions (not shown). Coil 34 is embedded in structural member 30 as shown (assuming structural member 30 is a plastic material).

The anvil 28 consists of ring 36 and platen 38 connected together by cylindrical guiding member 40. Ring 36 has a rectangular cross-section and is made of a magnetic material such as iron. Guiding member 40 attaches to ring 36 by a press fit. Platen 38 is attached to guiding member 40 by means of a machine screw (not shown). The hammer 26 has a force receiving surface 42 and a force delivering surface 44. The anvil 28 also has a force receiving surface 46 and a force delivering surface 48.

If there is no current flowing through coil 34, hammer 26 is free to slide back and forth along guiding member 40 subject only to the constraints imposed by the combination of structural member 30 and guiding member 32. Current flowing through coil 34 generates a magnetic field which exerts a force on ring 36 causing hammer 26 and anvil 28 to assume an extended position, i.e., the relative positions shown in FIG. 3.

In operation, a user places the force delivering surface 48 of the anvil 28 against a patient's chest or back in the gentlest possible way and coil 34 is energized by a series of current pukes. When the coil 34 is energized, hammer 26 and anvil 28 will assume the extended position shown in FIG. 3 and remain in that extended position for as long as the coil 34 is energized and the user does not apply a force to force-receiving surface 42 of the hammer 26.

Now assume that the user begins to apply a force (with their hand) to force-receiving surface 42 of the hammer 26 while the coil 34 is energized with a current puke. Nothing happens because the magnetic force from the energized coil 34 holding hammer 26 and anvil 28 in the extended position is greater than the force applied by the user.

When the current puke to the coil 34 ends, the magnetic force holding the hammer 26 and anvil 28 in the extended position ends and any opposition to the force applied by the user to the force receiving surface 42 of the hammer 26 disappears. The force-delivering surface 44 of the hammer 26 then strikes the force-receiving surface 46 of the anvil 28 thereby delivering a considerably greater force to platen 38 than simply the force applied by the user's hand alone. The force delivering surface 48 of the anvil 28 translates the impact from the hammer 26 against the anvil 28 to the patient's chest or back with which it is in contact. The process repeats with each current puke supplied to coil 34.

The work expended by the user is the product $F_1 d_h$, of the force $F_1$ applied by the user to the force receiving surface 42 of the hammer 26 and the distance $d_h$ traveled by the hammer 26 before striking the anvil 28. The user's work is converted into kinetic energy of the hammer 26. This kinetic energy is dissipated when the hammer 26 strikes the anvil 28 and the anvil 28 depresses the patient's flesh. The kinetic energy is converted into potential energy associated with the depression of the patient's flesh and heat. The user's work is balanced by the work $F_p d_p$ expended by the patient's body which resists the anvil 28 with a force $F_p$ over a distance $d_p$. Thus, the effective force applied by the anvil 28 to the patient's body is given by $F_p=(d_h/d_p)F_1$.

The ratio $(d_h/d_p)$ of the distance traveled by the hammer $(d_h)$ to the distance traveled by the patient's flesh $(d_p)$ is typically greater than three and consequently the percussor 22 described herein typically has a force-multiplying effect. For example, a user's force of 10 lbs is typically experienced as a force of 30 lbs or more by a patient.

Figure 4:
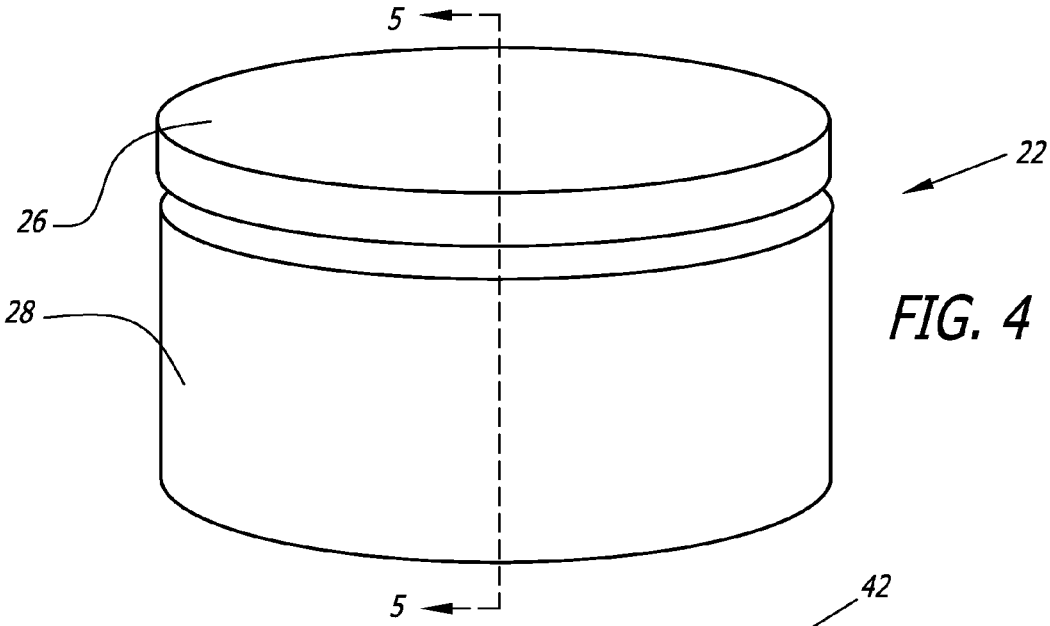
FIG. 4 is a perspective view of a second embodiment of the percussor of the present invention.
Figure 5:
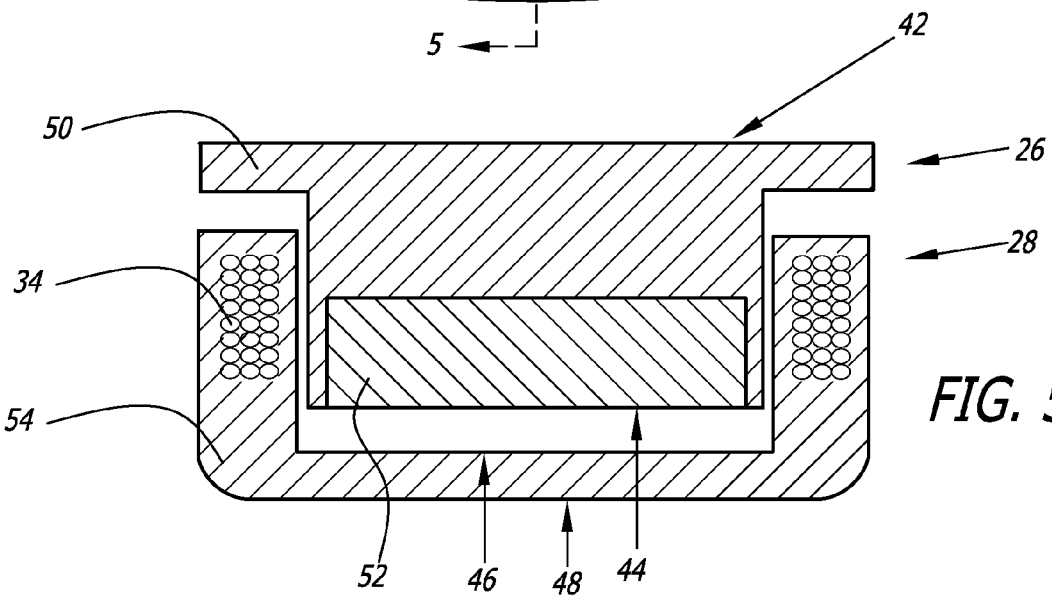
FIG. 5 is a sectional view taken along line 5-5 of FIG. 4 with the hammer shown in a neutral position relative to the anvil.
Figure 6:
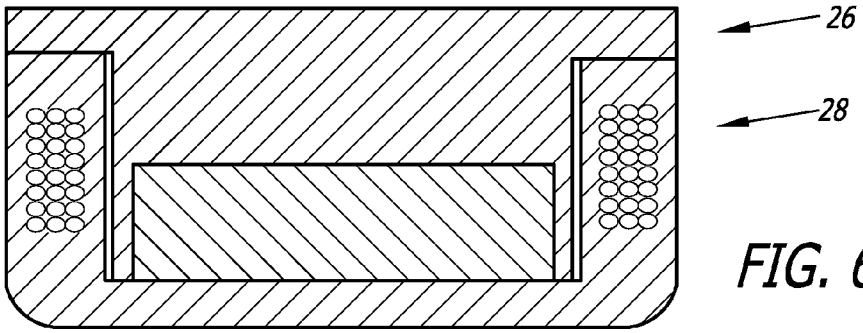
FIG. 6 is a sectional view taken along line 5-5 of FIG. 4 with the hammer shown in contact with the anvil.

A second embodiment of the percussor 22 is shown in FIGS. 4-6. It also consists of a hammer 26 and an anvil 28. The design details for the second embodiment are shown in the sectional views of FIGS. 5 and 6. The hammer 26 consists of a plastic structural body 50 in which is embedded a core 52 made of a magnetic material such as iron. The anvil 28 consists of a plastic body 54 in which is embedded coil 34 which surrounds core 52 when the hammer 26 is inserted into the anvil 28.

As in the first embodiment, the hammer 26 has a force receiving surface 42 and a force delivering surface 44, and the anvil 28 also has a force receiving surface 46 and a force delivering surface 48. If there is no current flowing through the coil 34, the hammer 26 is free to slide back and forth within the anvil 28 but limited in range by three pins (not shown) anchored into the curved wail of the anvil 28 and terminating in three vertical grooves (not shown) spaced 120 degrees apart in hammer 26. When a current flows through the coil 34 it generates a magnetic field which exerts a force on core 52 causing hammer 26 and anvil 28 to assume the positions shown in FIG. 5.

In operation, the percussor 22 is paced against the back or chest of a patient with the force delivering surface 48 of the anvil 28 in contact with the patient's body. The user holds the percussor 22 in place by gripping the force receiving surface 42 of the hammer 26 with one hand, palm on top, and then turns on the power. As described above, the force continually applied by the user to the force receiving surface 42 of the hammer 26 is converted into repeated impacts of force on the patient's body through the force delivering surface 48 of the anvil 28 as current impulses pass through the coil 34. Each time the current impulse through the coil 34 is ceased, the force delivering surface 44 of the hammer 26 impacts the force receiving surface 46 of the anvil 28. Each such impact delivers the force through the anvil 28 to the force delivering surface 48. The force associated with each impulse is significantly greater than the force being applied by the user to the force receiving surface 42 of the hammer 26 on a continuing basis.

Let us again assume that a user places the percussor 22 against a patient's back in the gentlest possible way and coil 34 is energized by a series of current pukes. Hammer 26 and anvil 28 will assume the positions shown in FIG. 5 and remain in those positions for as long as the technician does not apply a force to force-receiving surface 42. Again assume that the technician begins to apply a force to force-receiving surface 42 while the coil 34 is energized with a current puke. Nothing happens because the magnetic force holding hammer 26 and anvil 28 in the relative positions of FIG. 5 is typically greater than any force that can be manually applied by a user.

When the current puke ends, the magnetic force opposing the force applied by the user disappears and the force-delivering surface 44 of the hammer 26 strikes the force-receiving surface 46 of the anvil 28 as shown in FIG. 6. The hammer 26 thereby delivers a considerably greater force to the patient's back with which the anvil 28 it is in contact, as discussed above. As long as the user maintains a force on the hammer 26, the impacting process repeats with each current puke supplied to coil 34.

Figure 7:
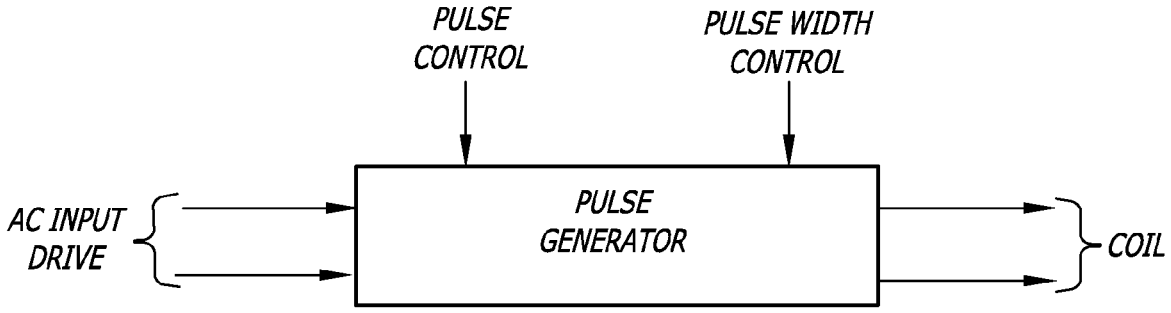
FIG. 7 is a schematic drawing illustrating the inputs and outputs of the pulse generator which supplies the driving current for the percussor.

A schematic of the puke generator required to drive the coil 34 is shown in FIG. 7. It preferably operates with standard 120 V AC input power and has means for controlling the frequency and amplitude, i.e., widths and rate of repetition, of the output pukes.

Figures 8, 9:
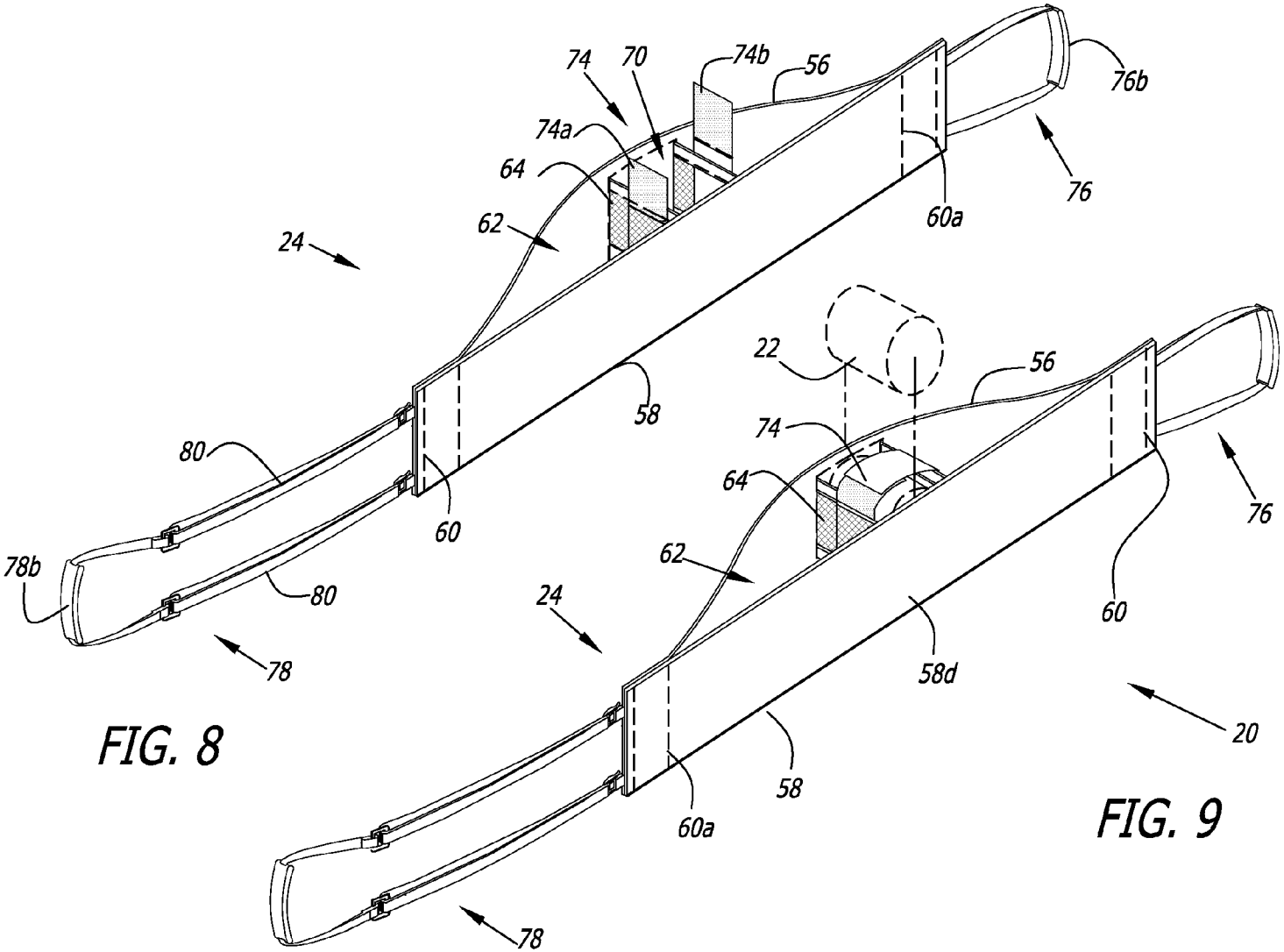
FIG. 8 is an elevated perspective view of the self-applicator of the present invention.
FIG. 9 is an elevated perspective view of the self-applicator of the present invention illustrating insertion of a percussor.
Figure 10:
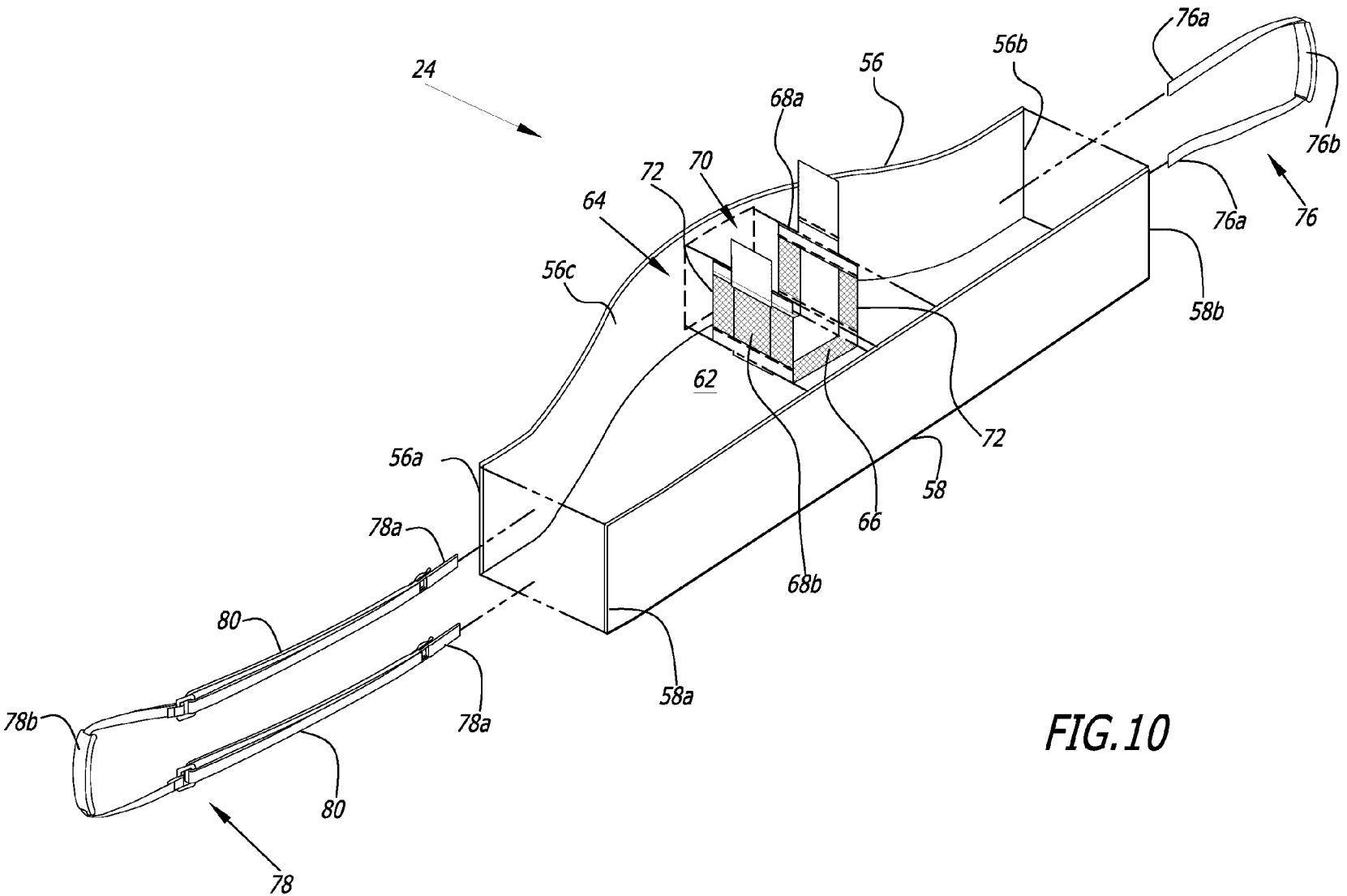
FIG. 10 is an exploded perspective view of the self-applicator of the present invention.

The self-applicator 24 consists of two substantially co-extensive straps having a pouch configured to accept and securely retain the percussor 22. FIGS. 8 through 10 illustrate the self-applicator 24 along with its various components.

The self-applicator 24 has a pair of straps 56, 58 being substantially co-extensive with one overlaying the other. The respective ends of the straps 56*a*, 58*a* and 56*b*, 58*b* are stitched 60 together or joined by any securing means know to those skilled in the art. One of the straps 56 is preferably slightly longer that the other strap 58 such that when the ends of the first strap 56*a*, 56*b* are joined to the ends of the second strap 58*a*, 58*b*, there is an open area 62 between the two straps 56, 58. Preferably, the stitching 60 or other securing means is applied a second time 60*a* for added securement.

A pouch 64 is disposed in the open area 62 between the straps 56, 58. The pouch 64 may be in the form of a U-shaped pocket having a bottom 66, upright sides 68*a*, 68*b* and an open top 70. The pouch 64 in configured and designed to accept the percussor 22 through the open top 70 and securely retain the percussor 22 therein. Front and back edges 72*a*, 72*b* of the pouch 64 are in contact with inside surfaces 56*c*, 58*c* of the straps 56, 58. At least one of the front and back edges 72*a*, 72*b* are attached to the inside surfaces 56*c*, 58*c* so as to securely retain the pouch 64 in the open area 62. Preferably, both front and back edges 72*a*, 72*b* are attached to the inside surfaces 56*c*, 58*c*.

The pouch 64 also includes a closure mechanism 74 designed to cover the open top 70. The closure mechanism 74 preferably comprises a pair of adjustable hook and loop straps 74*a*, 74*b*. The straps 74*a*, 74*b* preferably have essentially their entire mating surfaces covered by hook and loop material, i.e., VELCRO®, whereby the respective straps 74*a*, 74*b* can be adhered to each other at any point along their length. The closure mechanism 74 can also comprise snaps, buttons, a zipper, or other commonly known methods of closure.

A pair of handles 76, 78 are secured to the respective ends 56*a*/58*a*, 56*b*/58*b* of the straps 56, 58. The ends 76*a*, 78*a* of the handles 76, 78 are preferably secured between the ends 56*a*/58*a*, 56*b*/58*b* of the straps 56, 58 when they are stitched 60 together. At least one of the straps 78 includes an adjustable length harness 80 so that the length of the handle 78 may be changed to accommodate users of different sizes. Each of the handles 76, 78 include respective grips 76*b*, 78*b* for a user 82 to grasp in each of his/her hands 84.

The second strap 58 includes an applicator surface 58*d* that is configured to contact the back 86 of a user 82 when the self-applicator system 20 is being applied. The application surface 58*d* is aligned with the inside surface 58*c* at the point where the pouch 64 is disposed or secured. The applicator surface 58*d* preferably comprises a soft, comfortable material that will not irritate a user's skin and can easily and smoothly move during use. The applicator surface 58*d* may even include padding to provide comfort to the user.

The method of using the system 20 begins with arranging the self-applicator 24 on a surface such that the pouch 64 is oriented with the open top 70 pointing upwards. A user then inserts the percussor 22 into the open top 70 of the pouch 64. The percussor 22 is positioned in the pouch 64 such that the anvil 28 on the percussor 22 is pointed toward the inside surface 58*c* of the second strap 58. The closure mechanism 74 is secured around the percussor 22 so as to securely retain the percussor 22 in the pouch 64 in a manner that does not allow rotation, revolution or other similar movements during use.

Figure 11:
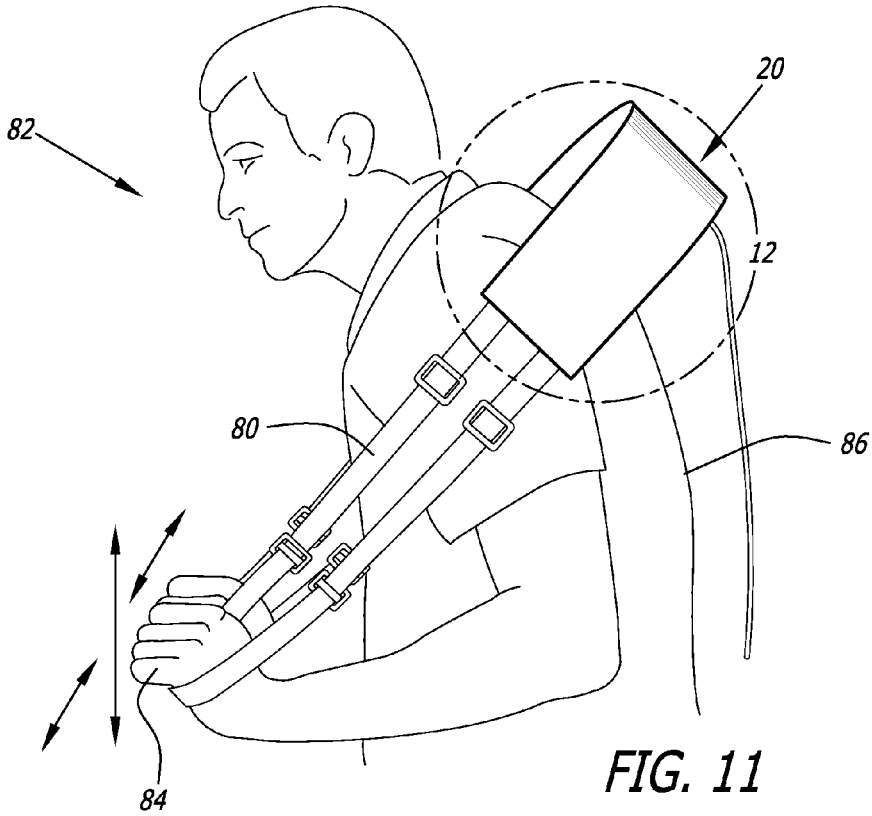
FIG. 11 is an environmental view of the force multiplying percussor and self-applicator system of the present invention being self-applied by a user.
Figure 12:
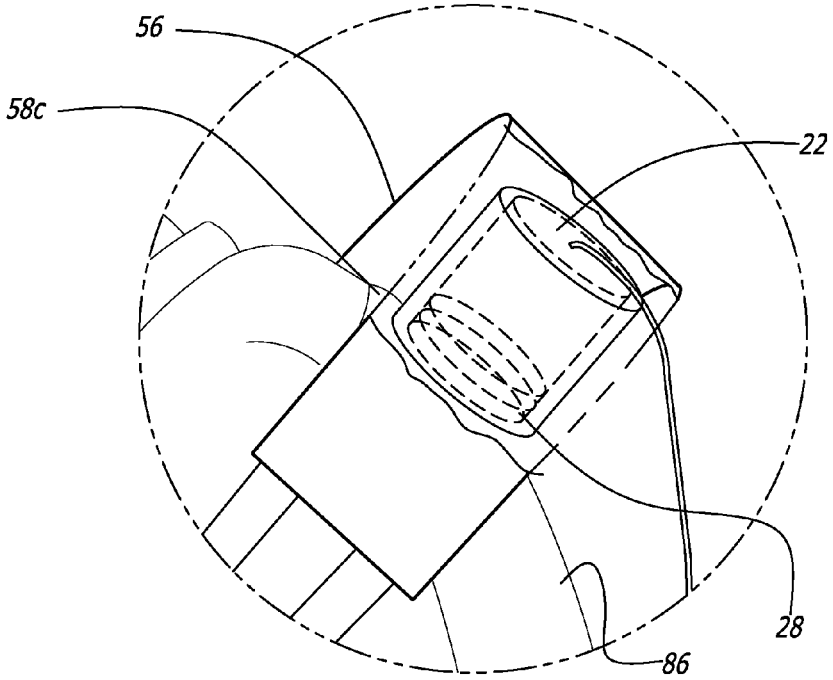
FIG. 12 is a close-up cut-away view of the force multiplying percussor and self-applicator system of the present invention being self-applied by a user.
Figure 13:
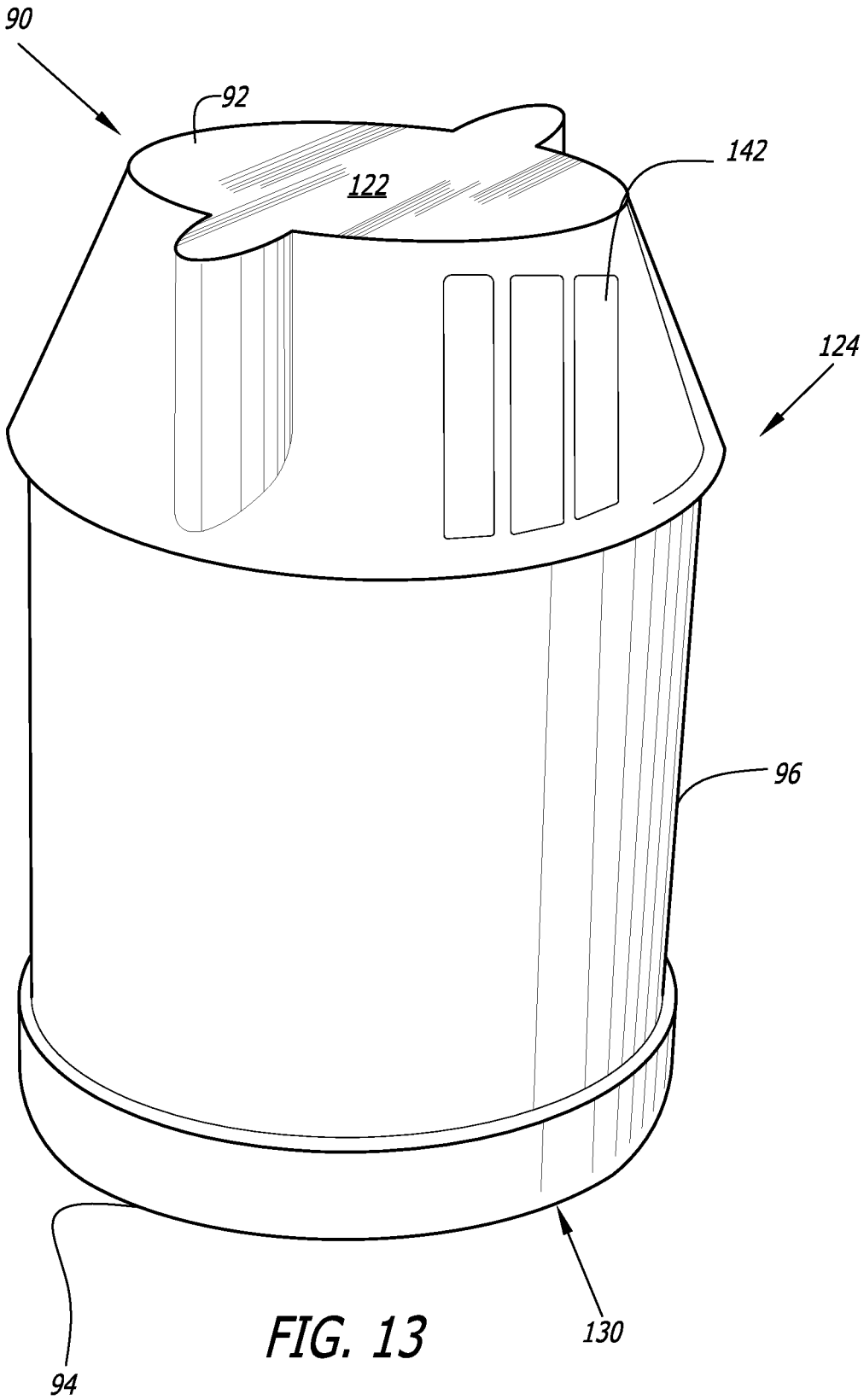
FIG. 13 is a perspective view of a particularly preferred embodiment of a percussor of the present invention.
Figure 14:
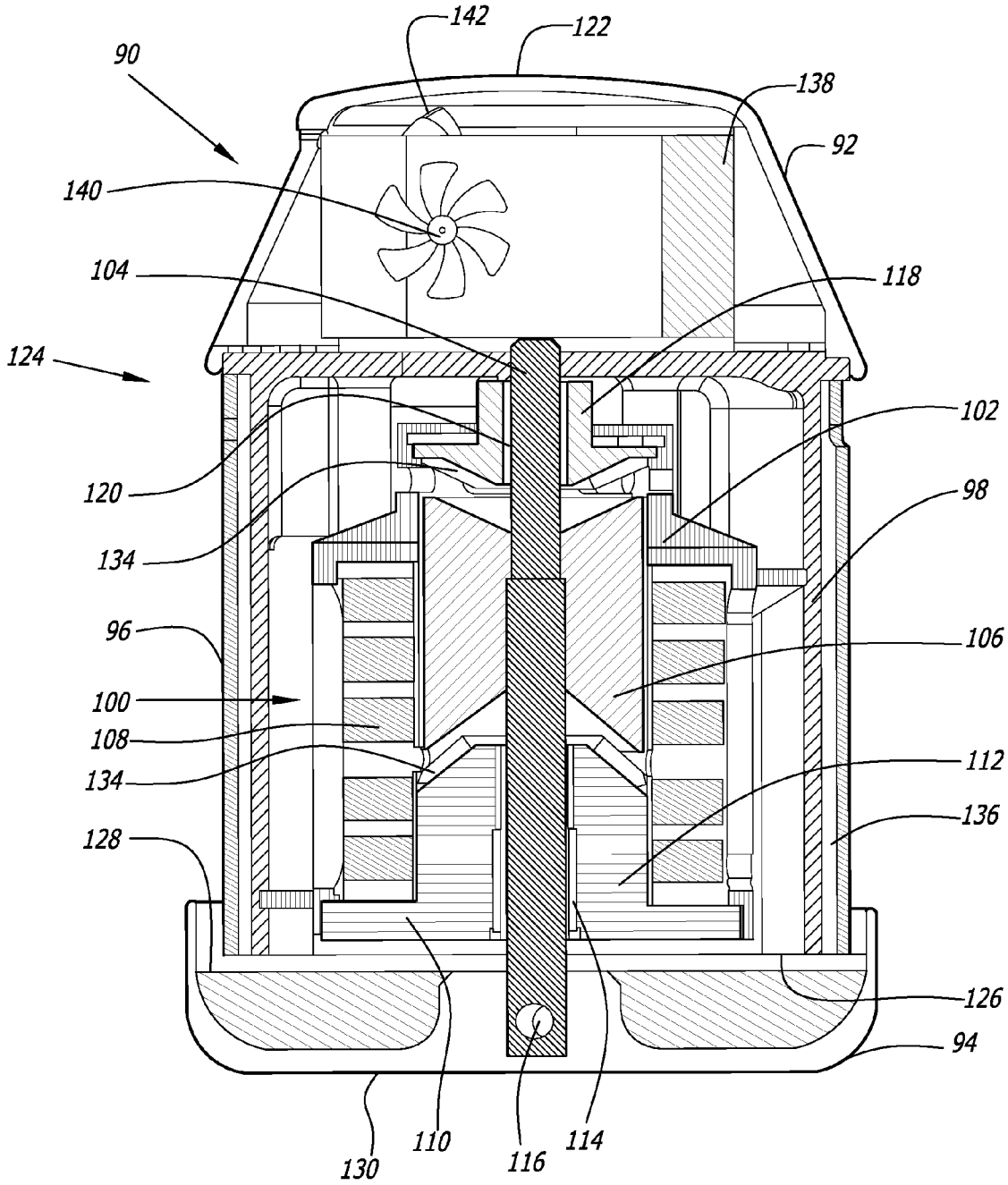
FIG. 14 is a cut-away view of the particularly preferred embodiment of the percussor depicted in FIG. 13.
Figure 15:
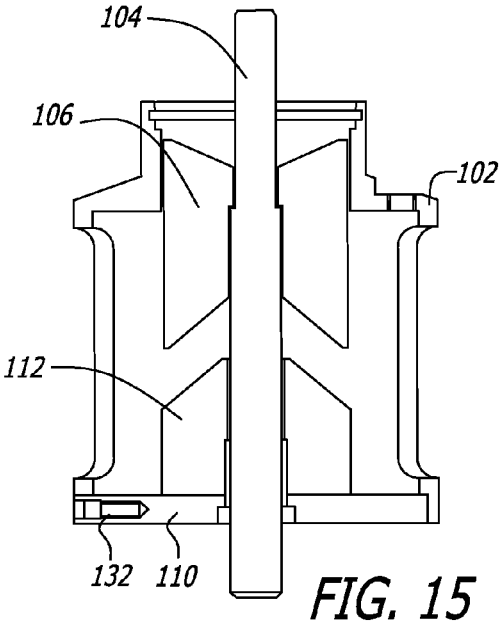
FIG. 15 is a partially dis-assembled view of the particularly preferred embodiment of the percussor of FIG. 14.

If necessary, the user 82 can adjust the length of the adjustable length harness 80 to make the system 20 more comfortable to use. The user 82 then grasps each of the handles 76, 78 in his or her hands 84 and self-applies the application surface 58*d* to his/her back 86. As illustrated in FIGS. 11 and 12, the self-applicator 24 spans the user's back 86 with the user's hand 84 in front of his/her body, pulling the handles 76, 78 forward to apply force to the force receiving surface 42 of the hammer 26 and resultant pressure to the back 86. The user 82 then turns on the percussor 22 with the results as described above.

By moving ones hand 84 up/down and side/side, the user 82 can self-apply the percussor 22 to almost any area of his/her back 86. By aligning the anvil 28 of the percussor 22 with the application surface 58*d*, the user is able to keep the anvil 28 in contact with the user's back 86 without the need for a treatment technician or the aid of any other person. The user can also more easily self-apply the percussor 22 to those parts of his/her back 86 that are most beneficial for the loosening or dislodging of bronchial secretions in the lungs, rather than try and describe to another person where to apply the percussor 22.

Except for the applicator surface 58*d*, described above, the self-applicator 24 and its various components are made from a sturdy, durable material such as nylon or similar polymer material. The goal in selecting a material is to make sure that the self-applicator 24 is comfortable for the user while still being durable enough to withstand the stresses of self-application and the movement of the percussor 22. The grips 76*b*, 78*b* preferably comprise a soft, durable polymer material such as polyurethane, latex, or similar materials, molded to form hand grips 76*b*, 78*b*.

FIGS. 13 through 18 illustrate a particularly preferred embodiment of the percussor 90 of the present invention. From the outside, the percussor 90 consists of a rear cover or hand hold 92, an anvil 94 and an intervening thermal shell 96. Inside of the thermal shell 96 is a housing 98, which encloses a solenoid 100. The solenoid 100 comprises an internal shell 102 containing a central shaft 104 upon which is mounted a plunger 106. The plunger 106 may be shaped as a cylinder with recessed cavities at its upper 106*a* and lower 106*b* ends. The plunger 106 may also be presented in other shapes so as to conform to adjacent parts as described below. The plunger 106 is made from magnetic material as the ring 36 or core 52 described above. A coil 108 surrounds the shaft 104 and plunger 106 and exerts magnetic forces thereon when energized.

The bottom of the shell 102 contains a front wall 110 that includes an upward extending base 112 that generally matches the shape of the recess in the lower end 106*b* of the plunger 106. The front wall 110 also includes a central opening 114 through which the shaft 104 extends. One end 104*b* of the shaft 104 protrudes through the front wall 110 and is connected to the anvil 94 by a screw 116 or similar securement mechanism. As the shaft 104 slides through the shell 102, the anvil 94 follows.

The top of the shell 102 contains a rear support bearing 118 secured thereto. The rear support bearing 118 has a lower surface that generally conforms to the shape of the recess of the upper end 106*a* of the plunger 106. The rear support bearing 118 also includes a central opening 120 through which the shaft 104 extends. The central opening 114 of the front wall 110 and the central opening 120 of the rear support bearing 118 cooperate to keep the shaft 104 in straight line, oscillating movement through the shell 102.

The rear cover 92 provides a hand hold for a user to grasp the percussor 90. In the terms of the previously described embodiment, the upper surface of the rear cover 92 provides a force receiving surface 122 of the hammer 124. The force delivering surface 126 of the hammer 124 is located at the bottom of the housing 98. The anvil 94 includes a force receiving surface 128 that receive impacts from the force delivering surface 126 of the hammer 124. The anvil 94 also includes a force delivering surface 130. These surfaces 122, 126, 128 and 130 interact as described above in the earlier embodiment.

Figure 16:
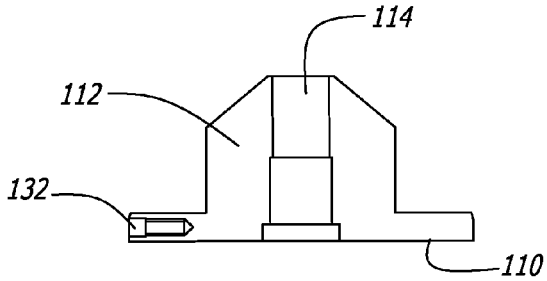
FIG. 16 is a cross-sectional view of the front wall of the particularly preferred embodiment of the percussor of FIG. 14.
Figure 16A:
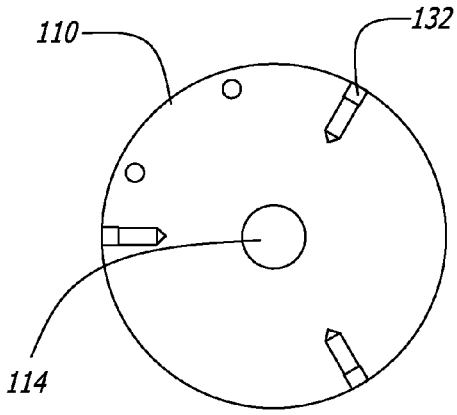
FIG. 16*a* is an end view of the front wall of the particularly preferred embodiment of the percussor of FIG. 14.
Figure 17:
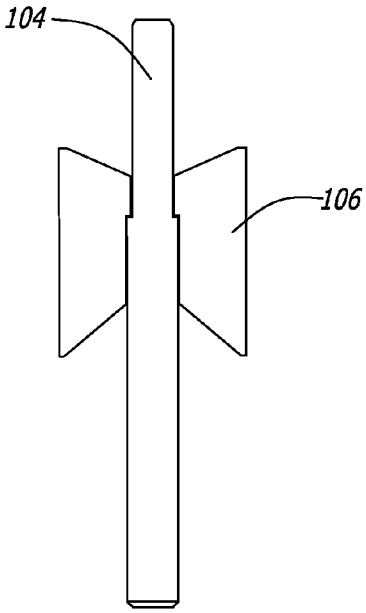
FIG. 17 is a side view of the shaft and plunger of the particularly preferred embodiment of the percussor of FIG. 14.
Figure 18:
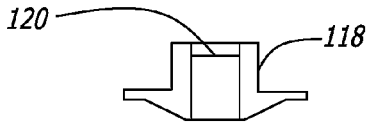
FIG. 18 is a cross-sectional view of the rear support bearing of the particularly preferred embodiment of the percussor of FIG. 14.

As shown in FIG. 16*a*, the front wall 110 includes set screw openings 132 around its perimeter. These set screw openings 132 are configured to receive set screws through the wall of the shell 102 so as to secure the front wall 110 thereto. The upper surface of the upward extending base 112 includes bumpers 134. The bumpers 134 are configured to cushion the impact between the plunger 106 and the base 112 when the coil 108 is energized. This cushioning is only intended to make the impact less jarring or noise generating—it does not lessen the force of any impact.

The thermal shell 96 is configured to insulate the user against heat generating by the oscillations of the solenoid 100 when the percussor 90 is in use. The thermal shell 96 provides an air gap 136 between the thermal shell 96 and the housing 98. In addition, the rear cover 92 houses the pulse generator 138 as discussed above, as well as a cooling fan 140. The pulse generator 138 is connected to the coil 108. As the pulse generator 138 energizes the coil 108, electricity is also supplied to the cooling fan 140, which draws air through the housing 98 and out the exhaust vents 142 to provide additional cooling.

The percussor 90 of this alternate embodiment may also be used with the self-applicator 24. The percussor 90 may fit within the pouch 64 as described above.

Although the system 20 has been described in detail for purposes of illustration, various modifications may be made without departing from the scope and spirit of the invention. The above-described disclosure is not intended to limit the scope of the invention. Accordingly, the scope of the present invention is determined only by the following claims.

What is claimed is:

1. A system for airway clearance, comprising:

a self-applicator assembly including a first strap overlaying and substantially co-extensive with a second strap, wherein the first and second straps are joined at their respective ends, and a pouch disposed between the first and second straps; and a force multiplying percussor secured within the pouch of the self-applicator assembly, the force multiplying percussor comprising an anvil having a force-receiving surface and a force-delivering surface configured for contact with a patient's body, a hammer having a force-receiving surface and a force-delivering surface, a housing and a thermal shell surrounding the hammer and not the anvil, wherein the housing and the thermal shell define an air gap therebetween, the hammer being attached to the anvil such that the force-delivering surface of the hammer and the force-receiving surface of the anvil are mechanically free to come together or move apart, a coil within the housing that causes the force-delivering surface of the hammer and the force-receiving surface of the anvil to separate when the coil is energized with an electrical current, a pulse generator that supplies repeated electrical current pulses to the coil, and a cooling fan for drawing air through the housing.

2. The system of claim 1, wherein the force-delivering surface of the hammer contacts the force-receiving surface of the anvil when the pulse generator is not supplying an electrical current pulse to the coil and when the force-receiving surface of the hammer is subjected to a compressing force.

3. The system of claim 1, wherein the force-delivering surface of the hammer does not contact the force-receiving surface of the anvil when the pulse generator is supplying an electrical current pulse to the coil and when the force-receiving surface of the hammer is subjected to a compressing force that is less than a pre-determined maximum force.

4. The system of claim 1, wherein the coil is attached to the anvil or the hammer.

5. The system of claim 1, wherein the anvil or the hammer comprises a magnetic material.

6. The system of claim 1, wherein the second strap has an application surface comprising a padded material configured for making physical contact with a user's back.

7. The system of claim 1, wherein the first strap is longer than the second strap so as to define an open region therebetween.

8. The system of claim 7, wherein the pouch is disposed in the open region and attached to one or both of the first and second straps.

9. The system of claim 1, wherein the pouch comprises a closure mechanism for securely holding the force multiplying percussor.

10. The system of claim 9, wherein the closure mechanism comprises adjustable hook and loop straps configured so as to accommodate airway clearance devices of varying sizes.

11. The system of claim 1, wherein a pair of handles are each attached to one of the respective ends of the first and second straps.

12. The system of claim 11, wherein one of the pair of handles is attached to one of the ends of the first and second straps by an adjustable length harness.

13. The system of claim 12, wherein the other one of the pair of handles is attached to the other of the ends of the first and second straps by a fixed length harness.

14. A method for using the system of claim 13, comprising the steps of:

inserting the force multiplying percussor into the pouch;

positioning the force multiplying percussor in the pouch such that the anvil on the force multiplying percussor is oriented toward the second strap;

grasping each of the pair of handles in a user's hands;

self-applying an application surface of the second strap to the user's back; and turning on the force multiplying percussor such that the force-delivering surface of the anvil contacts the user's back through the application surface.

15. The method of claim 14, further comprising the step of closing a closure mechanism on the pouch so as to securely hold the force multiplying percussor in the pouch.

16. The method of claim 14, further comprising the step of adjusting the length of an adjustable length harness on at least one of the pair of handles so that the user can comfortably perform the self-applying step.

17. The system of claim 1, wherein the force-receiving surface of the anvil and the force-delivering surface of the anvil are rigidly connected together.

18. A system for airway clearance, comprising:

a self-applicator assembly including a first strap overlaying and substantially co-extensive with a second strap, wherein the first and second straps are joined at their respective ends, and a pouch disposed between the first and second straps; and a force multiplying percussor secured within the pouch of the self-applicator assembly, the force multiplying percussor comprising an anvil having a force-receiving surface and a force-delivering surface configured for contact with a patient's body, a hammer having a force-receiving surface and a force-delivering surface, the hammer being attached to the anvil such that the force-delivering surface of the hammer and the force-receiving surface of the anvil are mechanically free to come together or move apart, and a housing and a thermal shell surrounding the hammer and not the anvil, wherein the housing and the thermal shell define an air gap therebetween.

19. The system of claim 18, wherein the force multiplying percussor includes a coil within the housing that causes the force-delivering surface of the hammer and the force-receiving surface of the anvil to separate when the coil is energized with an electrical current, a pulse generator that supplies repeated electrical current pulses to the coil, and a cooling fan for drawing air through the housing wherein the force-delivering surface of the hammer contacts the force-receiving surface of the anvil when the pulse generator is not supplying an electrical current pulse to the coil and when the force-receiving surface of the hammer is subjected to a compressing force, and wherein the force-delivering surface of the hammer does not contact the force-receiving surface of the anvil when the pulse generator is supplying an electrical current pulse to the coil and when the force-receiving surface of the hammer is subjected to a compressing force that is less than a pre-determined maximum force.

20. The system of claim 19, wherein the coil is attached to the anvil or the hammer.

21. The system of claim 18, wherein the anvil or the hammer comprises a magnetic material.

22. The system of claim 18, wherein the second strap has an application surface comprising a padded material configured for making physical contact with a user's back, and wherein the first strap is longer than the second strap so as to define an open region therebetween, and wherein the pouch is disposed in the open region and attached to one or both of the first and second straps.

23. The system of claim 18, wherein the pouch comprises a closure mechanism for securely holding the airway clearance device therein, wherein the closure mechanism comprises adjustable hook and loop straps configured so as to accommodate airway clearance devices of varying sizes.

24. The system of claim 18, wherein a pair of handles are each attached to one of the respective ends of the first and second straps, wherein one of the pair of handles is attached to one of the ends of the first and second straps by an adjustable length harness, and wherein the other one of the pair of handles is attached to the other of the ends of the first and second straps by a fixed length harness.

25. A method for using the system of claim 24, comprising the steps of:

inserting the force multiplying percussor into the pouch;

positioning the force multiplying percussor in the pouch such that the anvil on the force multiplying percussor is oriented toward the second strap;

grasping each of the pair of handles in a user's hands;

self-applying an application surface of the second strap to the user's back; and turning on the force multiplying percussor such that the force-delivering surface of the anvil contacts the user's back through the application surface.

26. The method of claim 25, further comprising the step of closing a closure mechanism on the pouch so as to securely hold the force multiplying percussor in the pouch.

27. The method of claim 26, further comprising the step of adjusting the length of an adjustable length harness on at least one of the pair of handles so that the user can comfortably perform the self-applying step.

28. The system of claim 18, wherein the force-receiving surface of the anvil and the force-delivering surface of the anvil are rigidly connected together.

* * * * *